United States Patent [19]

Sumner

[11] Patent Number: 4,690,218

[45] Date of Patent: Sep. 1, 1987

[54] METHOD FOR DEPTH CONTROL AND DETONATION OF TUBING CONVEYED GUN ASSEMBLY

[75] Inventor: Cyril R. Sumner, Houston, Tex.

[73] Assignee: Halliburton Company, Duncan, Okla.

[21] Appl. No.: 848,008

[22] Filed: Apr. 3, 1986

[51] Int. Cl.[4] ..... E21B 43/116

[52] U.S. Cl. ..... 166/297; 166/55.1; 166/64; 166/254

[58] Field of Search ..... 166/254, 297, 55.1, 166/55, 65.1, 72, 64, 299

[56] References Cited

U.S. PATENT DOCUMENTS

| | | | |
|---|---|---|---|
| 2,092,337 | 9/1937 | Spencer | 166/55.1 |
| 2,476,136 | 7/1949 | Doll | 166/254 |
| 3,291,208 | 12/1966 | Kenneday | 166/254 |
| 4,436,155 | 3/1984 | Brieger | 166/297 |
| 4,509,604 | 4/1985 | Upchurch | 175/4.52 |
| 4,544,035 | 10/1985 | Voss | 166/55.1 X |

*Primary Examiner*—Stephen J. Novosad
*Assistant Examiner*—Hoang C. Dang
*Attorney, Agent, or Firm*—William J. Beard

[57] ABSTRACT

A method of registering perforating guns in a tubing conveyed perforating assembly as set forth. On a tubing string, a TCP assembly is lowered in a cased well. In the tubing string, a logging cable supported radioactive logging tool is then moved along the well to controllably locate the formation of interest. After the depth of this formation is known, the tubing string is moved to reposition the TCP assembly in registry with the formation of interest. The logging tool is retrieved only partially and is then lowered to operative contact with the TCP assembly to provide a signal path for operation of a firing mechanism to fire the shaped charges to form perforations into the formation.

14 Claims, 1 Drawing Figure

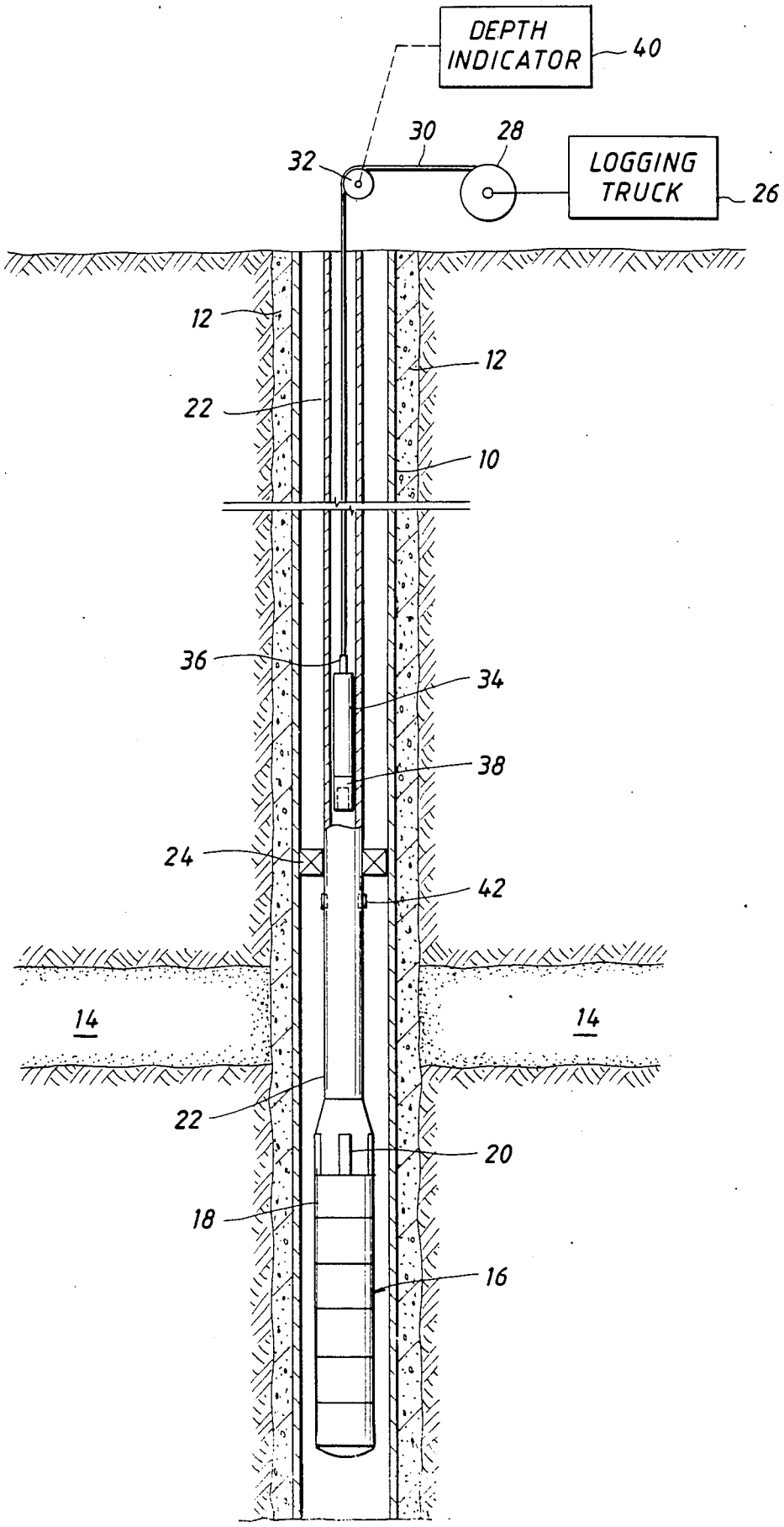
DEPTH INDICATOR
40
30
28
32
LOGGING TRUCK
26
12
12
22
10
36
34
38
24
42
14
14
22
20
18
16

METHOD FOR DEPTH CONTROL AND DETONATION OF TUBING CONVEYED GUN ASSEMBLY

BACKGROUND OF THE INVENTION

After a well has been drilled and casing has been placed in the well, the next step typically undertaken to complete the well is to perforate the well. The perforations are ideally formed opposite a formation from which oil and gas will hopefully be obtained. If the formation is perhaps 100 feet thick, locating the formation along the cased hole is not too difficult. Moreover, perforations placement into the formation is not quite so critical in view of the relative thickness of the formation. Thus, if there are perforations above or below the formation, it typically may not cause too much of a problem. Considering this example; if it is known that the formation is about 100 feet thick, a tubing conveyed perforating (TCP) assembly having perforating guns spanning about 100 feet is lowered into the well. When the TCP assembly is positioned in the well, misalignment relative to the formation is not a great problem by virture of the relative large thickness of the formation.

In the situation where the producing formation is only 10 feet thick, proper positioning of the TCP assembly is much more important. Assume that the formation of interest has a thickness of 10 feet; in that instance, registration of the TCP assembly may be crucial. Assume that the formation of interest is located about 12,000 feet deep in a well which has been drilled 10,000 feet. An error of 1% in measuring the depth from the surface to the formation is an error of 100 feet, 10 times larger than the formation thickness. Any measurement error of this magnitude could easily cause the perforations to completely miss the location of this thin formation. Thus, it is very difficult to align the TCP assembly solely from measurements obtained from the surface as, for example, by measuring the length of tubing in the well. The tubing is subject to elongation, and wireline supported tools are also subject to elongation.

In the past, one technique to overcome this problem has involved the use of a radioactive logging tool to obtain a correlation log to locate the formation of interest. Thus, the radioactive logging tool is used to make measurement through the wall of the casing and the surrounding cement holding the casing in place. This sequence of operation involves lowering a radioactive logging tool on a wireline or logging cable to a depth sufficient to move the logging tool past the formation of interest. The logging tool provides continuous data output to the surface such that the data is evaluated, thereby determining the location of the formation of interest. When it is found, the depth of the logging tool in the well is then determined. This is difficult if the logging tool is at a significant depth, but there are procedures available such that the elongation of the supporting cable connected to the logging tool can be evaluated and a precise location is then obtained. Knowing this depth, the TCP assembly is then positioned in the well opposite the formation of interest. As an example, the tubing string and the TCP assembly affixed to the bottom can be lowered almost to the bottom of the well, significantly past the estimated location of the formation of the interest. The logging tool is then used to locate the formation. The logging tool is removed and tubing is also removed to adjust the location of the TCP assembly. This procedure is continued until the TCP assembly is located opposite the target formation. Then, detonation can be initiated. The TCP assembly is detonated by dropping a weight in the tubing string, actuation of a pressure signal for pressure actuated detonating devices or dropping an electric line in the tubing string to connect with the TCP assembly for detonation by electrically triggered means.

This procedure just described primarily involves locating the formation with the logging tool, movement of the tubing string to relocate the TCP assembly opposite the formation while removing the logging tool. The latter two steps may be reversed in sequence. It also requires the detonation sequence to be initiated by means well known in the art. As mentioned above, three typical systems used including the dropped weight, pressure actuated detonation, or electric signal detonation using electric line. This sequence of TCP assembly positioning can require substantial amounts of rig time.

By contrast, the method of the present disclosure enables the formation to be located through the use of a logging tool, the logging tool being left in the tubing string even after the formation has been located. Moreover, a radioactive logging tool of conventional construction and supported on a conventional logging cable is provided with an electric line connector cooperative with a mating connector at the top end of the TCP firing head. The TCP firing head is affixed to the TCP assembly above the perforating guns. With this arrangement of apparatus, the TCP assembly positioning sequence then is simplified. The TCP assembly is lowered on the tubing string to a depth greater than the location of the formation. The radioactive logging tool is then used to precisely locate the formation of interest. Recall that the radioactive logging tool is able to find the formation through the casing and cement which isolates the well from the formation. As before, it is required to locate the formation also through the tubing as well as the casing. This can be readily accomplished. Once it is located and the depth of the formation is then noted, the tubing string is raised in the well to bring the TCP assembly into registration with the formation. This may require raising of the tubing string and is accompanied by raising of the logging tool also. However, they are only repositioned, not retrieved fully from the well. Once registration is obtained, the logging tool can then be lowered to make operative connection with a cooperative plug and socket whereby the electric line initiator is operatively connected to the TCP assembly. This enables a signal to be sent from the surface through an electric line to the TCP assembly for proper operation of the perforating guns.

DETAILED DESCRIPTION OF THE DRAWINGS

So that the manner in which the above recited features, advantages and objects of the present invention are attained and can be understood in detail, more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

The single FIGURE shows a TCP assembly supported on a tubing string in a well and further illustrates a radioactive logging tool having an electric line connector means affixed to the bottom thereto for connection with the TCP assembly to be registered opposite a formation, prior to perforating into the formation.

DETAILED DESCRIPTION OF THE PREFERRED EMBODIMENT

In the single drawing, the numeral 10 identifies a casing which is placed in a well during completion procedures. The casing is held in location by cement 12 placed around the casing. The well is of substantial depth passing through many different horizons, one of the horizons including a formation 14. The well is to be perforated at the formation 14. For purposes of illustration, assume that the formation 14 is relatively thin, perhaps only a few feet in thickness. Moreover, assume that it is quite deep in the well, and assume that the well is deeper than the formation 14. Typically, at the time that the well is cased and cemented, the approximate location of the formation is then known. The precise depth and thickness of the formation may not be fully known until appropriate logging procedures are undertaken. In any event, the partially completed well is cased and casing is held in location by placing cement around the casing.

Assuming that the formation 14 is thought to be located between about 10,000 and 11,000 feet deep in the well, and further assuming as an example that the well has been drilled to 12,000 feet, the next step is to assemble the TCP assembly 16. The TCP assembly includes one or more perforating guns. They span a length which is determined at the time of putting the assembly together. So to speak, the number of perforating guns in the assembly can be increased substantially without limit so that it may be several hundred perforating guns. They are deployed with a density to achieve a desired number and orientation of perforations in the well. The TCP assembly 16 thus includes a plurality of perforating guns. The guns are triggered or fired by an electrically operated firing head 18. The firing head incorporates an upwardly facing connector 20. The connector is at the top end of the TCP assembly. It is located at the bottom end of the tubing string 22. The tubing string threads to and makes up with the TCP assembly 16 with the connector 20 exposed, facing upwardly in the tubing string 22. The tubing string is assembled joint by joint until the TCP assembly 16 is at a substantial depth in the well. Using the example mentioned above, it might be appropriate to locate the TCP assembly 16 at perhaps 11,500 foot depth. Moreover, this method of assembly is a well known procedure undertaken with a view of locating the TCP assembly at any selected depth. As needed, one or more packers are placed in the well. A packer is shown at 24, located above the formation 14 to be perforated. Precise location of the packer relative to the formation typically is estimated, the packer being located to isolate the region of the well where the perforations are formed. If need be, a bridge plug is located below this region also, perhaps limiting downward travel of the TCP assembly. Again, packers and plugs are implemented through practice of routine procedures in completion of the well.

A logging truck 26 located adjacent to the well includes a supply reel or drum 28 which provides an armored logging cable 30. The cable 30 includes sufficient conductors to enable data to be sent up the cable to the logging truck 26. In addition, a conductor is included to provide an electrical signal for operation of the firing head 18. The cable 30 is spooled over a sheave 32 and extends into the tubing string 22. The cable 30 supports a radioactive logging tool 34. The precise nature of the radioactive logging tool is subject to variation and is described generally as a tool which is able to perform logging operations in cased holes. In other words, it operates through the surrounding metal tubular members and the cement on the exterior to locate the formation 14. This is a type of correlation log which is correlated with an open hole log or other geophysical data obtained previously. Thus, the logging tool is used to obtain correlation data locating the formation 14. to this end, the logging tool is of conventional construction supported on the cable 30 through a cable head 36. It is modified primarily by the incorporation of a downwardly facing connector means 38. Connector means 38 is affixed to the bottom end of the logging tool. It is constructed and arranged to mate with the connector means 20 at the TCP assembly therebelow. A conductor path through the logging cable is also included, the conductor extending to the connector means 38 to provide an operative signal from the surface. This sequence will be described in detail hereinafter.

Consider the present procedure in the context of this example. Assume that the formation is only 10 feet in total depth. Assume also that it is somewhere between 10,000 and 11,000 feet in the well which extends down to about 12,000 feet. Among the preliminary preparatory steps is the step of placing the packer 24 at some depth in the well. Perhaps this would be at 9,500 feet in this example. The precise location of the packer is not crucial. Moreover, the tubing string 22 is assembled to lower the TCP assembly 16 to a depth of about 11,500 feet. Once the TCP assembly 16 is located at a depth well below the formation 14, the radioactive logging tool 34 is then lowered on the cable 30 into the well. If it is known that the formation of interest is somewhere between 10,000 and 11,000 feet depth in the well, the logging tool 34 is lowered to some distance past 11,000 feet and is then used to conduct correlation logging operations moving up the well. This requires logging operations to be conducted through both the wall of the tubing and casing and through the surrounding cement layer. This obtains data which can be correlated with other information known about the formations and the precise location of the formation 14 is then determined. Once it has been located, the depth of the radioactive logging tool can be determined through use of a depth indicator 40. It is connected by suitable electronic or mechanical means to the sheave 32. Suitable correction techniques are well known to compensate for cable elongation. This enables determination of the precise location of the formation 14.

Once the precise location of the formation is known, it is then compared with the temporary location of the TCP assembly 16. This location is known by measuring the tubing string or alternatively by placing a radioactive collar at a specified location in the tubing string. The numeral 42 identifies the location of a radioactive collar placed in the tubing string. It is used as a marker. Thus, the logging tool 34 locates the radioactive collar 42. Once the collar is located relative to the formation 14, this enables the tubing string to be moved to register the TCP assembly 16 opposite the formation. This movement is dependent on knowing the precise distance between the TCP assembly 16 and the collar 42. This distance can be determined at the time of making a tubing string and placing the collar 42 in the tubing string.

Consider as an example that the collar 42 is precisely 500 feet above the TCP assembly 16. Assume further that the formation 14 has been located precisely 100 feet below the radioactive collar 42. This data would then require that the tubing string be raised 400 feet to be brought into registry with the formation 14. The tubing string is then raised by this distance. For the moment, the logging tool 34 can be pulled upwardly by a few hundred feet to be retracted to a position out of the way of the TCP assembly 16. Once the TCP assembly 16 is located adjacent to formation 14, the logging tool 34 is then lowered. It is lowered until it rests on the firing head 18. The cooperative plug and socket are then connected. They are connected by the weight of the logging tool 34 which forces the means 20 and 38 together to achieve connection. When this connection is made, this assures the availability of a signal path utilizing the logging cable 30. The signal path is used to apply a firing signal down the cable 30 from surface equipment provided for such an operation, and the signal is conducted through the means 38 and also the means 20. This delivers the electrical firing signal to the firing head 18. This in turn fires the perforating guns. The signal will ignite the charges to form the perforations necessary to complete the well into the formation 14. For instance that the formation is 10 feet in thickness, perforations might be located every 4 or 5 inches vertically with 3 or 4 perforations on a common horizon to form radially divergent perforations into the formation at all points of the compass. When this is accomplished, the perforations are properly vertically registered relative to the formation location. It is particularly desirable to accomplish precise registration by virtue of the fact that the formation is relatively small. After firing, the logging tool 34 is retained on the cable and removed from the tubing. The tubing string may be left in place and the well produced or tested. The well operator has various options including tubing removal. If a permanent packer is set, the tubing cannot be pulled from well borehole. This is called a permanent type completion. If the object is to remove the fired TCP assembly, a retrievable packer is set. The well operator can unseat the packer and remove the packer and TCP assembly when he desires. This is called a temporary completion. Suitable production tubing and other production equipment is then installed after the well has been cleared of the TCP assembly 16.

An important feature of the present procedure is the fact that the wireline can be left in the well without retrieving the logging tool 34, enabling subsequent connection of the plug and socket. There is a significant reduction in the number of trips out of the well and back into the well with the logging apparatus.

While the foregoing is directed to the preferred embodiment, the scope is determined by the claims which follow.

What is claimed is:

1. A method of registering a tubing conveyed perforating assembly at a desired location in a well comprising the steps of:

(a) setting a packer in the well at some location above the approximate location of the desired formation;

(b) lowering on a tubing string a tubing conveyed perforating assembly having a firing mechanism therewith, the lowering step extending the tubing string into the well until the tubing conveyed perforating assembly is below the approximate location of the desired formation;

(c) lowering a radioactive logging tool into the well on a logging cable;

(d) operating the logging tool along the well to locate the desired formation into which perforations are desired;

(e) raising or lowering the tubing conveyed perforating assembly on the tubing string to a position in the well registered with the formation wherein this step comprises: (1) initially installing a radioactive marker means in the tubing string prior to placing the tubing string in the well, (2) measuring the distance along the tubing string between the radioactive marker means and the tubing conveyed perforating assembly, (3) locating the radioactive marker means in the well through use of the radioactive logging tool, (4) then moving the tubing string in the well as a function of the location of the radioactive marker means located in step (3), and (5) wherein the step of moving the tubing string is dependent on the measured distance between the radioactive marker means and the tubing conveyed perforating assembly and also on the location of the desired formation in the well determined in step (c);

(f) moving the logging cable to achieve an operative connection between the firing mechanism and the logging cable; and (g) initiating operation of the firing mechanism through the logging cable to form perforations into the formation.

2. The method of claim 1 wherein the tubing string is first lowered into the well after the well has been cased and cemented in place and thereafter lowering the logging tool in the tubing string on the logging cable.

3. The method of claim 1 including the step of operating the logging tool along a portion of the well where the formation is located to determine the precise depth in the well of the formation, and then raising the tubing string supporting the tubing conveyed perforating assembly to a registered position adjacent the formation.

4. The method of claim 1 wherein the tubing string is placed in the well to support the tubing conveyed perforating assembly at a selected depth in the well and conducting the logging step through the tubing by positioning the logging tool in the tubing to locate the formation.

5. The method of claim 4 including the step of moving the tubing conveyed perforating assembly upwardly in the well after initially placing sufficient tubing in the tubing string that the tubing conveyed perforating assembly is below the region where the desired formation is located, and isolating a portion of the well by installing the packer means thereabove, and further including the step of lowering the logging cable in the tubing string until the firing mechanism for the tubing conveyed perforating assembly is contacted thereby.

6. The method of claim 5 including the step of initially installing cooperative plug and socket means on the lower end of the logging tool and on the upper end of the firing mechanism to enable operative connection therebetween on the interior of the tubing string.

7. The method of claim 1 including the step of conducting logging operations to obtain a correlation log indicative of the formation and further including the step of correlating that log with additional information regarding the well to thereby locate the formation.

8. The method of claim 1 including the step of retrieving the logging cable with the logging tool supported thereby and also retrieving therewith a connector means affixed thereto cooperative with mating connector means on the firing mechanism.

9. The method of claim 8 further including the post perforation step of removing the tubing string from the well after the perforations have been formed by the tubing conveyed perforating assembly.

10. The method of claim 9 including the post perforation step of first retrieving the logging cable and logging tool supported thereby, and then retrieving the tubing string supporting the tubing conveyed perforating assembly after perforations have been formed.

11. The method of claim 3 including the step of retrieving the logging cable with the logging tool supported thereby and also retrieving therewith a connector means affixed thereto cooperative with mating connector means on the firing mechanism.

12. The method of claim 11 including the step of retrieving the logging cable with the logging tool supported thereby and also retrieving therewith a connector means affixed thereto cooperative with mating connector means on the firing mechanism.

13. The method of claim 12 further including the post perforation step of removing the tubing string from the well after the perforations have been formed by the tubing conveyed perforating assembly.

14. The method of claim 13 including the post perforation step of first retrieving the logging cable and logging tool supported thereby, and then retrieving the tubing string supporting the tubing conveyed perforating assembly after perforations have been formed.

* * * * *